US006474956B2

(12) United States Patent
Davis et al.

(10) Patent No.: US 6,474,956 B2
(45) Date of Patent: Nov. 5, 2002

(54) BARREL FAN WITH ENCLOSED MOTOR

(75) Inventors: James L. Davis, Jackson, MI (US); Robert H. Lazebnik, Jackson, MI (US); Stanley J. Riske, Hanover, MI (US)

(73) Assignee: Airmaster Fan Company, Jackson, MI (US)

( * ) Notice: Subject to any disclaimer, the term of this patent is extended or adjusted under 35 U.S.C. 154(b) by 0 days.

(21) Appl. No.: 09/773,738

(22) Filed: Feb. 2, 2001

(65) Prior Publication Data

US 2002/0106286 A1 Aug. 8, 2002

(51) Int. Cl.[7] ..... F04B 53/00
(52) U.S. Cl. ..... 417/234; 417/362; 417/423.1
(58) Field of Search ..... 417/234, 362, 417/423.1, 423.14

(56) References Cited

U.S. PATENT DOCUMENTS 2,258,284 A * 10/1941 Findley ..... 417/326
2,790,596 A * 4/1957 Stirling ..... 417/362
3,871,795 A * 3/1975 Habdo et al. ..... 417/360
4,077,747 A * 3/1978 Burenga ..... 417/234
5,738,167 A * 4/1998 Asbjornson et al. ..... 417/362
6,190,140 B1 * 2/2001 Matson ..... 417/362

OTHER PUBLICATIONS

Northern Tool, Aug. 1999, Northern Tool, Northern Tool.com–48in. Belt Drive Industrial Fan, 2 pages.*
Douglas Wright, May 2000, Dept. of Mechanical and Materials Engineering The University of Western Austrailia, 12 pages.*
Warehouse Equipment and Supply Co., 1998, Warehouse Equip. and Supply Co., 3 pages.*
Northern Industrial Products, Northern Industrial Products, Fans and Blowers, 9 pages.*

* cited by examiner

*Primary Examiner*—Charles G. Freay
*Assistant Examiner*—John F Belena
(74) *Attorney, Agent, or Firm*—Young & Basile, P.C.

(57) ABSTRACT

A barrel fan for the heavy duty circulation of air at the floor level consisting of a cylindrical tubular housing having a guarded rotating propeller blade therein. The blade is driven by a belt connected to an electric motor located on the lower exterior portion of the housing preferably shielded by a skirt in ventilating communication with the housing interior for motor cooling purposes. The motor is pivotally mounted and a spring interposed between the motor and housing maintains the tension within the belt.

5 Claims, 2 Drawing Sheets

FIG-3
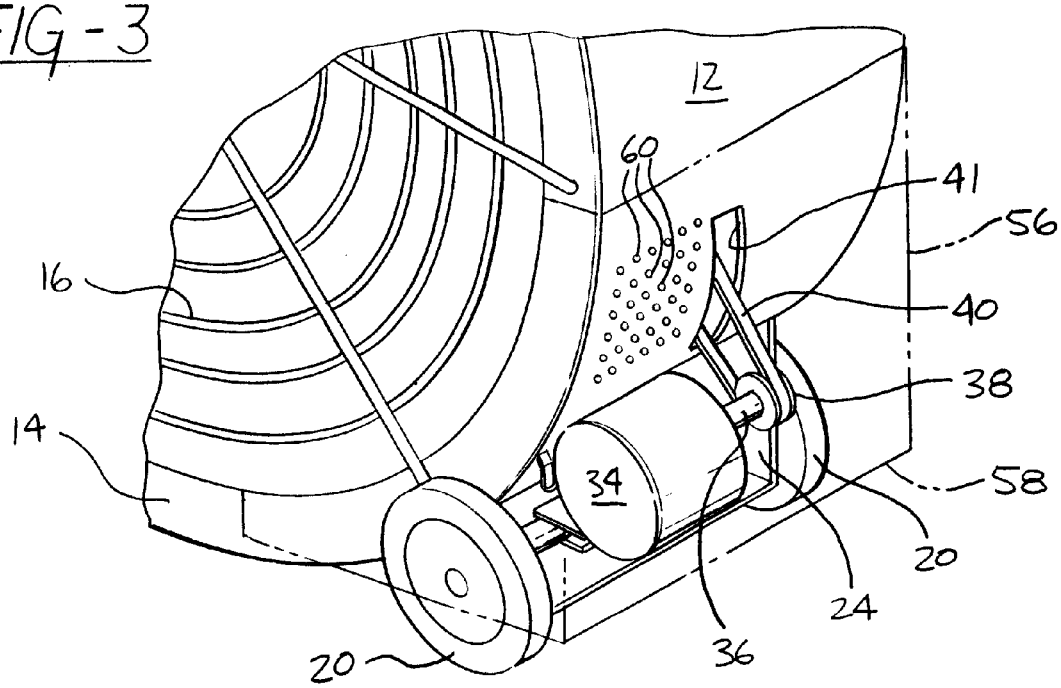
FIG-4
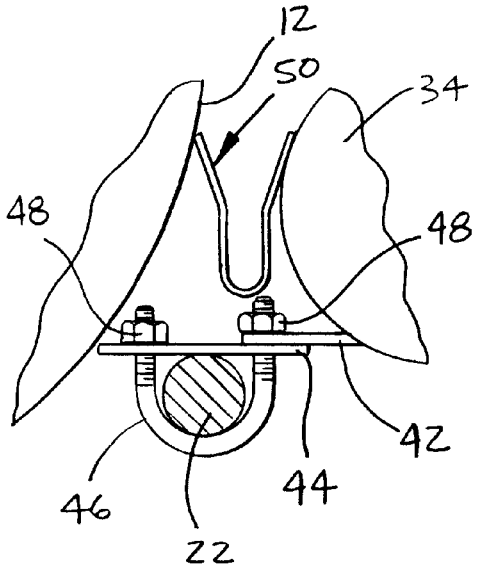
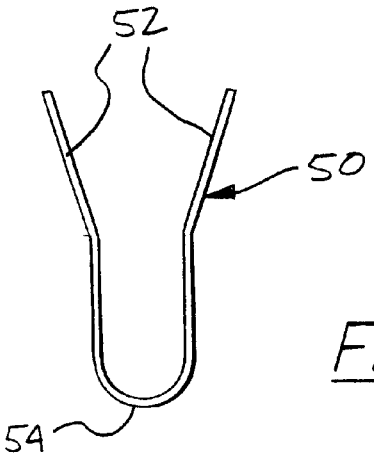
FIG-5

BARREL FAN WITH ENCLOSED MOTOR

BACKGROUND OF THE INVENTION

1. Field of the Invention

The invention pertains to belt driven barrel fans movably positionable upon a floor surface.

2. Description of the Related Art

Large industrial type fans for circulating air adjacent a floor surface are often used in factories and warehouses for cooling and ventilation purposes. Such fans may be located adjacent an open door for moving air into an enclosure, or for blowing fumes away from a work area. A common fan of this type is known as a "barrel fan" so named as the propeller or blade housing is in the form of a tubular barrel open at each end. A rotatable blade shaft is coaxially located within the housing having a blade mounted thereon. In conventional constructions, an electric motor is located within the housing and drives the blade shaft through a flexible belt. Guard grills are normally located at each end of the barrel.

The air circulated by the fan passes through the interior of the barrel housing, and over a period of time, a large amount of unfiltered air passing through the housing causes dust and dirt particles to build up on the blades, grills and electric motor. While such buildup of airborne debris on the blades and grills can be cleaned therefrom, the deposit of such foreign matter within the motor is difficult to remove and will enter the motor interior, reduce the flow of required cooling air through the motor, and often cause shorting or premature motor overheating and motor failure.

Also, the maintaining of the belt tension between motor and blade shaft of conventional barrel fans requires periodic adjustment. As the maintenance of fans is usually overlooked, it is a common problem to run fans until they malfunction and must be replaced, or major components must be replaced, and the invention pertains to a low maintenance industrial type fan of high capacity which eliminates some of the problems previously present with this type of fan.

OBJECTS OF THE INVENTION

It is an object of the invention to provide a barrel fan driven by an electric motor wherein the electric motor is located exteriorly of the barrel fan housing, and is not within the air flow path.

A further object of the invention is to provide a barrel fan driven by an electric motor wherein the electric motor is located exteriorly of the barrel fan housing, is pivotally mounted, and a spring interposed between the barrel fan housing and electric motor maintains tension within the motor drive belt.

An additional object of the invention is to provide a barrel fan operated by an electric motor located exteriorly of the barrel fan housing wherein the electric motor is enclosed within a skirt for protective and aesthetic purposes and ventilation means are provided to circulate cooling air over the electric motor.

SUMMARY OF THE INVENTION

A barrel fan in accord with the invention includes a relatively large tubular housing which may be 42 inches in diameter, or greater, wherein each end of the housing is provided with a protective grill, and interiorly, a blade or propeller shaft is rotatably mounted upon bearings and supports the blade assembly. The shaft also includes a belt sheave of the V-belt type. Housing support structure is formed on the barrel fan housing for supporting the housing on the floor such that the blade shaft will be substantially horizontally disposed, and the support structure usually includes wheels for facilitating portability of the fan.

Conventional barrel fans mount an electric motor within the barrel fan housing which is connected to the shaft sheave by a V-belt or may be directly attached to the shaft. However, in the instant invention, an electric motor is mounted exteriorly of the fan housing and the motor drive belt passes through the housing.

In accord with the invention,.the electric motor is pivotally mounted upon the axle supporting the fan housing wheels, this axle is mounted upon the fan housing by a bracket and disposed parallel to the blade shaft. The pivotal mounting of the motor support upon the axle is achieved by conventional U-bolts, and a Y-shaped spring is interposed between the fan housing and electric motor casing tending to pivot the electric motor about the wheel axis in a direction away from the blade shaft. This biasing force maintains the desired tension on the V-belt, and should V-belt replacement be necessary, the electric motor can be easily pivoted toward the blade shaft to release the tension on the belt and permit a new belt to be easily placed upon the blade shaft and electric motor sheaves.

Preferably, a metal skirt removably attached to the barrel fan housing extends around the electric motor, and partially encloses the fan housing wheels. This skirt hides the electric motor from sight and further protects the electric motor from damage and encloses the belt at the motor sheave for safety purposes. Ventilation openings are defined in the lower portion of the fan housing to permit air within the fan housing to enter the shield and circulate air therein for cooling the electric motor. As the bottom of the shield is open, ventilating air entering the shield is discharged to the atmosphere.

The above described relationship has several advantages. By locating the electric motor exteriorly of the barrel fan housing, the air circulated by the fan is not passing over the electric motor, as is the case with electric motors mounted interiorly of the fan housing so that maximum air flow through the housing is achieved, and the accumulation of dust and foreign particles on the electric motor in accord with the invention occurs much slower than with conventional barrel fans. Further, the use of an economical spring interposed between the barrel fan housing and the electric motor casing permits the proper belt tension to be maintained on the V-belt even though some stretching may occur and maintenance in this respect is eliminated and replacement of the belt is easily performed. The mounting of the electric motor on the wheel axle reduces costs and eliminates a special supporting bracket for the motor, and the skirt defining a combination motor and wheel enclosure results in an attractive barrel fan appearance while providing protection for the belt and motor.

BRIEF DESCRIPTION OF THE DRAWINGS

The aforementioned objects and advantages of the invention will be appreciated from the following description and accompanying drawings wherein:

FIG. 4 is a detail elevational sectional view as taken through the wheel axis illustrating the mounting structure for the electric motor and the spring, and FIG. 5 is an end elevational view of the spring, per se.

DESCRIPTION OF THE PREFERRED EMBODIMENT

Figure 2:
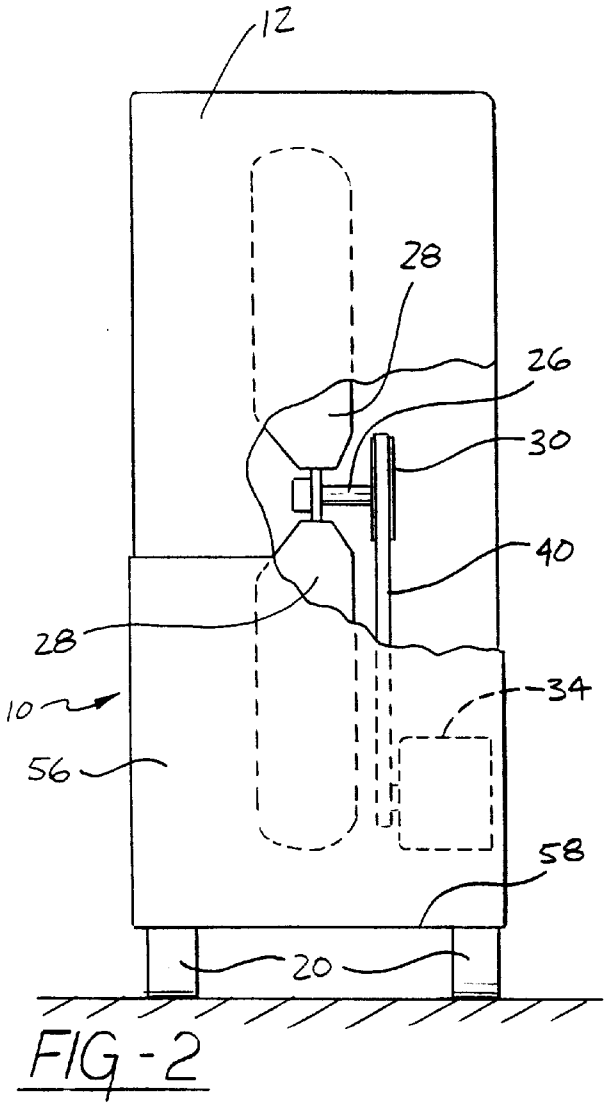
FIG. 2 is a side elevational view, with the fan housing partially broken away, as taken from the right of FIG. 1, FIG. 3. is a partial perspective view of the electric motor and wheel assembly, the skirt being shown in phantom lines.
Figure 1:
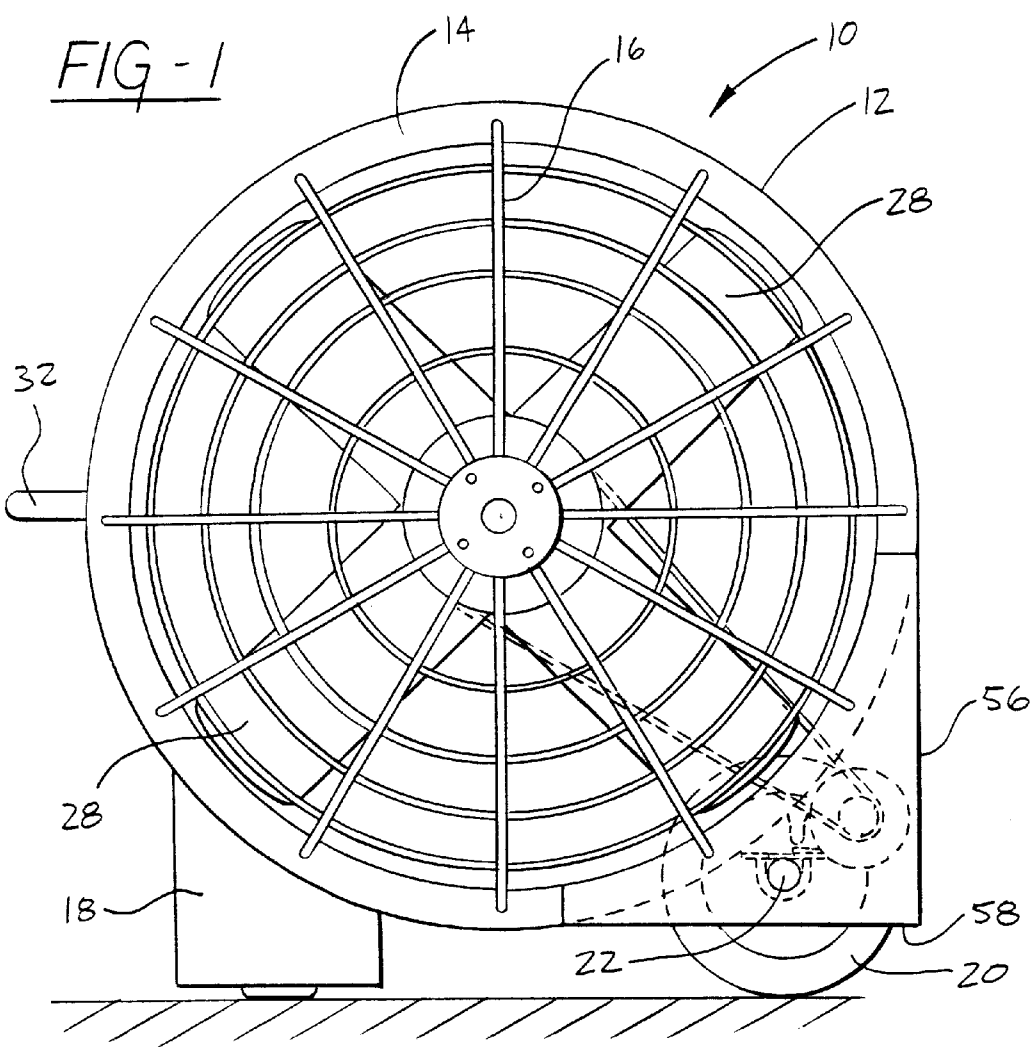
FIG. 1 is a front elevational view of a barrel fan utilizing the concepts of the invention.

The assembled barrel fan 10 is shown in elevation in FIG. 1 and includes a cylindrical housing 12 having open ends and an inwardly extending circular lip 14 is defined at each housing end. A guard grill 16 is located at each of the housing 12 ends and is attached to the housing by the grill wires extending through holes defined in the lips 14.

The barrel fan housing 12 is supported upon a column 18, FIG. 1, and a pair of wheels 20 mounted upon an axle 22 which extends parallel to the axis of the housing 12. The axle 22 is attached to the housing 12 by a bracket 24 as will be appreciated from FIG. 3.

Within the barrel fan housing 12 is a blade shaft 26 rotatably supported upon bearings, not shown. The axis of the blade shaft 26 is substantially coincident with the axis of the housing 12, and a plurality of blades or propellers 28 are mounted upon the shaft for rotation therewith. The shaft 26 is rotated by a drive belt passing over the pulley 30 attached to shaft 26. A handle 32 is mounted on the housing 12 permitting the column 18 to be lifted from the supporting floor surface and the barrel fan 10 may then be rolled about upon the wheels 20.

The blade shaft 26 is rotated by the electric motor 34 which is located exteriorly of the housing 12 on a lower portion thereof. The electric motor 34 includes a drive shaft 36 having a pulley 38 affixed thereto whereby the V-belt 40 passing over pulleys 30 and 38 permits the motor 34 to rotate the shaft 26 and blades 28. A rectangular opening 41, FIG. 3, is defined in the housing 12 permitting the belt 40 to pass through the housing 12.

The motor 34 is mounted upon a plate 42, FIG. 4, which is mounted upon an axle bracket 44, FIG. 4. The axle bracket 44 is held in place by U-bolts 46, two sets of U-bolts being used and spaced along the wheel axle 22. As the U-bolts 46 are tightened by nuts 48, the U-bolts which circumscribe the axle 22 pivotally mount the motor plate 42 and motor 34 relative to the wheel axle 22. The bolts 48 are tightened firmly, but not so tight as to prevent the pivoting action of the motor support.

The proper tension within the V-belt 40 is maintained by a spring 50, FIGS. 4 and 5, which may be formed of spring plate material and includes a pair of diverging arms 52 interconnected by the integral bridge 54. As will be appreciated from FIG. 4, the spring 50 is interposed between the exterior of the housing 12 at the lower region of the housing and the casing of the electric motor 34. In this manner, a biasing force on the motor 34 in a clockwise direction about the axle 22, FIG. 4, is produced which will tension belt 40 and maintain the proper belt tension even though belt wear or stretching may occur.

A skirt 56, preferably formed of metal sheet material, is of a U-configuration and encloses the lower outer portion of the housing 12 about the wheels 20 and motor 34. The skirt 56 is removably mounted upon the housing 12 by fasteners and includes the open bottom 58. A plurality of vent holes 60 are formed in the housing 12 adjacent the motor 34 whereby air within the barrel fan housing 12 will be forced into the skirt 56 and circulate around the motor 34 for cooling purposes. This cooling air is discharged through the skirt open bottom 58 to the atmosphere.

Because the chamber defined by the skirt 56 is closed at the top due to its tangential relationship to the housing 12, ambient foreign matter will not fall upon the motor 34, and the skirt 56 fully encloses the motor 32 and belt 40 for safety purposes. As will be appreciated from FIG. 1, the skirt 56 extends downwardly sufficiently to enclose three-quarters of the wheels 20 and the skirt produces a pleasing aesthetic appearance for the barrel fan assembly, as well as complying with safety requirements.

As only the cooling air entering the skirt 56 through the vent holes 60 circulates about the motor 34, the location of the motor exteriorly of the primary airflow path through the housing 12 prevents the motor from becoming quickly contaminated by airborne particles as is the case with conventional barrel fans having interior drive motors. Further, by locating the electric motor outside of the fan air path, improved airflow characteristics through the fan are achievable increasing the fan efficiency. The arrangement of the invention permits the electric motor to be easily serviced, or replaced, and the pivotal spring biased mounting of the electric motor assures proper belt operation.

It is appreciated that various modifications to the inventive concepts may be apparent to those skilled in the art without departing from the spirit and scope of the invention.

What is claimed is:

1. A barrel fan comprising, in combination, a tubular barrel housing having an axis and a lower side portion, a blade shaft rotatably mounted within said housing substantially coaxial with said axis, a blade mounted on said shaft, a belt pulley mounted on said shaft, an electric motor having an output shaft pulley, an electric motor support pivotally mounted on the exterior of said housing, said motor being mounted on said support for pivotal movement away and toward said shaft, a spring interposed between said motor and said housing biasing said motor away from said blade shaft, a flexible belt connecting said blade shaft belt pulley and said motor output shaft pulley, said spring maintaining said belt tight, an axle mounted on said barrel housing lower side portion having a length and axis substantially parallel to said barrel housing axis, said electric motor support being pivotally mounted upon said axle, and wheels rotatably mounted on said axle to facilitate movement of said barrel fan.

2. In a barrel fan as in claim 1, said electric motor support including a mounting plate, and removable clamps pivotally mounting said mounting plate upon said axle.

3. In a barrel fan as in claim 2, said clamps comprising U-bolts extending about said axle and through said mounting plate.

4. In a barrel fan as in claim 1, a skirt defined on said barrel housing lower side portion enclosing said electric motor.

5. In a barrel fan as in claim 4, ventilation openings defined in said barrel housing lower side portion adjacent said electric motor and within said skirt to permit air circulating within said housing to enter said skirt and cool said electric motor.

* * * * *